United States Patent [19]

Koch

[11] Patent Number: 4,858,311

[45] Date of Patent: Aug. 22, 1989

[54] TRANSPORT SYSTEM FOR ELECTRICAL CABLES

[75] Inventor: Max Koch, Meggen, Switzerland

[73] Assignee: Komax AG, Dierikon, Switzerland

[21] Appl. No.: 133,634

[22] Filed: Dec. 16, 1987

[30] Foreign Application Priority Data

Dec. 23, 1986 [CH] Switzerland ..... 5155/86
Sep. 23, 1987 [CH] Switzerland ..... 3683/87

[51] Int. Cl.[4] ..... H01R 43/00

[52] U.S. Cl. ..... 29/857; 29/867; 29/868; 29/566.3; 29/745; 29/748

[58] Field of Search ..... 29/825, 857, 867, 868, 29/566.1, 566.3, 745, 748

[56] References Cited

U.S. PATENT DOCUMENTS 4,156,961 6/1979 Agoh ..... 29/566.3
4,734,965 4/1988 Schaefer ..... 29/857 X

FOREIGN PATENT DOCUMENTS 0182592 5/1986 European Pat. Off. .
2622360 12/1977 Fed. Rep. of Germany .
2702188 7/1978 Fed. Rep. of Germany .
3340744 5/1984 Fed. Rep. of Germany .

*Primary Examiner*—P. W. Echols
*Assistant Examiner*—Taylor J. Ross
*Attorney, Agent, or Firm*—Horst M. Kasper

[57] ABSTRACT

A device for the transporting of cable sections is provided where cables (19), with a length of up to about 10 meters, are transported step by step from processing station to processing station along a cable-processing line with a processing station disposed on the two sides of the cable-processing line. A cable (19), gripped on one side by a stationary gripper (15), is discharged with a cable feed device with the aid of an insertable deflector (49) into a receiver provision (11) for forming a cable bundle (20). The receiver device (11), with the cable bundle (20) on the one hand, and the two cable ends (21, 22) gripped by a gripper (18) on the other hand, are moving in a forward direction independent of each other cyclically in like fashion. The gripper (18) of a rotatably disposed transfer module (17) can be rotated during a transfer cycle by 180 degrees such that the two cable ends (21, 22) as desired can be directed toward one or toward a second side of the processing line. Instead of the conventionally required pair-wise provided processing stations for the processing of the two cable ends (21, 22), only one such station is sufficient, which is disposed either on one and/or on the second side of the processing line. The finished processed cable is discharged or pulled out of the transport container (1) at the end of the processing line.

23 Claims, 6 Drawing Sheets

TRANSPORT SYSTEM FOR ELECTRICAL CABLES

BACKGROUND OF THE INVENTION

1. Field of the Invention

The invention relates to a transport device for electrical cables in a production station for the processing of electrical cables of a certain length, with at least one shifting-motion device, which can be moved stepwise in horizontal direction perpendicular to the axis of the cable ends, and which is provided with grippers which grip the cable ends, and which grippers can open and close, and which transport device further comprises a cable dump at the end of the shifting-motion device.

2. Brief Description of the Background of the Invention Including Prior Art

Such a transport device is a component of a production station for the processing of electrical cables of different lengths, different cross-sections, or different kinds, for the wiring of electrical plants in automobile and vehicular construction, for household appliances, or the like. The individual cables are automatically selected from a wire feeder and are cut in preselected lengths and are received by the transport device, which guides them stepwise along a processing line from processing station to processing station. During these steps, the cable ends are for example stripped and are provided with various connections and terminals, such as plug connectors, cable shoes, or the like. Both individual cable pieces as well as multipole connectors in busbar plug units can be automatically processed in desired production numbers for further processing.

A cable transport device in such a production station for the transport of cable sections perpendicular to their axes is taught, in addition to other related devices, in the German Patent Application Laid Open DE-OS 1,622,360. In particular, FIGS. 1 and 2 of DE-OS 1,622,360 illustrate in a side view an endless circulating transport system with a transport chain deflected by two chain wheels, where the transport chain comprises transporting clamps for gripping of an end of a cable section. In each case, two clamping jaws of the transport clamps are, in each case, tiltably supported between two clips and two hinge axles of an endless transport chain. The clamping jaws of the transport clamps are maintained closed by the force of a spring. In the region of the cable input and at the cable discharge, the clamping jaws are opened by control curves and by control rollers against the force of the spring. The drive of the transport chain is performed in steps, controlled by a specially formed worm thread gear driven by a drive motor provided with braking arrangements. Various processing stations are disposed along the upper strand of the transport chain next to the transport chain and above the transport chain, depending on the desired kind of processing of the respective end of a cable section. The reference teaches further that the complete transport device comprises two units, disposed in parallel next to each other, and that the parallel distance of the two chains can be adjusted by a shiftable support of one unit on a machine frame. The distance of the two units depends on the length of the cable sections to be processed and is adjusted by an adjustment device, not illustrated.

It is a disadvantage of this cable transport device that practically two equal mirror-like constructed transport units are necessary. A further disadvantage comprises that the lengths of the cables to be processed are limited and can be varied only between a minimum length, in case of a completely adjoining transport unit, and a maximum length, in case of a completely separated transport unit. Cable sections, with a length greater than 2 to 3 meters, cannot be processed with the taught transport device. Furthermore, two independent processing lines are required for the processing of the two cable ends.

The German Patent Application Laid Open DE-OS 3,340,744 teaches a further such cable processing station which also comprises a cable transport device realized as two endless transport chains, disposed in parallel to each other at a certain distance and deflected by two chain wheels in each case. Flush-aligned and releasable gripper pairs are arranged at the circumference of the two chains, which grip the two ends of each individual cable. The distance between the two chains can be varied and the cut-off cables, depending on their lengths, hang more or less down between the two transport chains and form a loop. In order to form a loop in the region of the cable feed, it is necessary to form the connection plate, serving as a cable guide between the two transport chains, as tiltable door or flap, which opens automatically when required and which closes again upon the feeding of a new cable. In addition, covering casings are required below the transport device between the two chains in order to prevent the downward hanging cable loops from getting stuck somewhere during the transport. A number of processing stations for the treatment of the two cable ends are provided successively at the two outsides of the transport chain. A step drive, actuated by an electric motor via a worm gear and a maltese cross-drive, moves the cable cuttings step by step from processing station to processing station.

It is a disadvantage of this transport device that also two independent processing lines are required for the processing of the two cable ends. In addition, this device is inadequate to transport longer cables without problems. Loops of cables, which are longer than, for example, 2 to 3 meters, would spread out on the floor without control and would slide or drag on the ground floor during the transport from processing station to processing station. A further disadvantage comprises that removal and discharge of individual cable strands is rendered very difficult in case of possible disturbances. In such cases, the complete bundle of the cable loops, disposed on top of each other and in part slid into each other, has to be removed in most situations.

SUMMARY OF THE INVENTION

1. Purposes of the Invention

It is an object of the invention to provide a cable transport device which allows to transport cable sections of substantial lengths, without requiring the cable loops to be slid or dragged along.

It is another object of the invention to provide a cable transport device which avoids cable loops of getting stuck or entangled by covers or casings along the transport-line path.

It is yet another object of the present invention to require only one processing station for the processing of the two cable ends, where the processing station can be disposed on one or the other side of the transport-line path.

These and other objects and advantages of the present invention will become evident from the description which follows.

2. Brief Description of the Invention

A transport device for electrical cables in a production station for processing of electrical cables of a certain length comprises a cable supply station furnishing a cable having an end to be picked up. A forward shifting device is stepwise movable in horizontal direction perpendicular to the direction of the cable ends. The transport device also comprises a forward and backward movable transfer carrier. A joint transfer module is attached to the forward and backward movable transfer carrier. This transfer module is rotatable at least around an axis running perpendicular to the axis of the cable ends and perpendicular to the direction of motion of the forward shifting device. Movable grippers are attached to the forward shifting device. These grippers can be opened and closed and are provided to support the cable ends and for gripping the two cable ends. A cable depository dump is disposed at one end of the forward shifting device. The transport device further comprises a frame, a drive device, and a stationary gripper module. Stationary grippers are attached to the stationary gripper module. A receiver device is movably supported by the frame and adapted for receiving cables of different lengths. This receiver device is step-wise movable in a circulation path by the drive device. A bulk length of the cable can be inserted into the receiver device and can, at least in the region of the cable dump, be removed again from the receiver device. The cable ends are supported before and after a cycle stroke motion by the stationary grippers of the stationary gripper module.

The receiver device for the reception of cables of different lengths can be a transport container.

A shiftable deflector can be moved and positioned into the circulation path. The transport device can comprise a cable feed, for moving cable from the cable supply and for discharging the excess length of a cable, supported at one end, into the transport container with the aid of the shiftable deflector, thereby forming a cable bundle.

The deflector can be a guide piece covering the full charge opening of the transport container.

A base face can be disposed in the transport container face with a surrounding side face wall of the transport container. This transport container can include an upwardly open charge opening. A double floor can be disposed in the inside of the transport container. Means can be provided for moving the double floor in a direction perpendicular to the base face of the transport container such that the double floor cab serve as a discharge device.

Preferably, a pull-out device is disposed at the end of the forward shifting device. Said pull-out device can pull the cable out of the transport container.

The transport container can be disposed on the circulation path on the continuously and endlessly circulating transport member.

Preferably, the length of the charge opening of the transport container is at least greater than the length of the base face.

Rails can be mounted to the frame such that the transport containers are guided slidingly by the rails on the circulation path. Preferably, the drive unit, which is step-wise moving the transport containers, is provided by pneumatic positioning members.

At least one stationary gripper module can be tiltably disposed around an axis running parallel to the direction of motion of the advance shifting device.

An endless circulating transport member forming a transport compartment can be provided in the receiver provision for different-length cables. Two fixedly disposed sidewalls can run parallel to the direction of motion and perpendicular to the running course of the transport member. The transport compartment can be provided in advance direction between the two fixedly disposed sidewalls. Webs can delimit the transport compartment and form a front and a rear wall which can protrude perpendicularly.

The transport member can be a toothed belt. The protruding webs can be an integrated component of the toothed belt and can be fixedly disposed on the toothed belt.

Preferably, a U-shaped projection fixture is tiltably hinged in the center of the base at the transport member, perpendicular to the direction of motion of the transport member. The two protruding webs can be parts of the U-shaped projection fixture. Preferably, the subdivision of the projection figure is double the size at the transport member as compared with the center distance between two webs.

A method for the transporting of cable sections comprises the following procedures: A cable is transported to a transfer position. The cable is gripped with a gripper of a cable pulling module. The cable is pulled so far until the cable pulling module contacts a stop element. The cable is inserted into a cable feed. A guide tube is opened composed of two half-cylinders and surrounding the cable. A deflector is slid above the opening of the transport container. The cable end is gripped by a gripper of a first stationary gripper module. The cable is advanced gripped on one side with the cable feed. The cable is directed with a deflector into the charge opening of the transport container. A cable bundle is formed in the transport container. The length of the advanced cable is measured and the cable length is cut to a desired size. The cable is gripped with the two grippers of the transfer module. The formed cable bundle is separated from the cable supply. The guide tube is opened and the cable is released by the gripper of the first stationary gripper module. The transfer module is advanced by an advance stroke in forward direction simultaneously with the transport container at the same cycle for moving the cable bundle together with the gripped cable ends in a direction perpendicular to the cable ends. The cable ends are gripped with a pair of stationary gripper modules. The cable is released by the grippers of the transfer module and a return stroke of the transfer module is performed.

The cable gripped by the grippers of the stationary gripper module gripping the cable ends with grippers of a second transfer module can be processed. The cable gripped by the grippers of the stationary gripper module advancing the cable can be released and the processed cable can be dumped into a depository dump.

The advantages achieved by the invention comprise in particular that cable sections can be transported along processing stations of a length of, for example, up to 10 meters, without a loop of the cable trailing and dragging on the floor and possibly getting damaged, or where the possibility exists that the cable gets stuck at a certain position of the station. It is possible, based on the rotatability of the support device for the cable ends, that the two gripped ends of each cable section are being processed by the same processing stations. Thus, one of the relatively expensive processing stations, hitherto required in pairs, can now be saved. Various processing stations can thus be disposed only on one side of the processing line, successively or alternatingly left and right of the two sides of the processing line. A further advantage is provided in that a discharge and removal of individual cable strands, in case of a possible disturbance, can be performed without difficulty.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
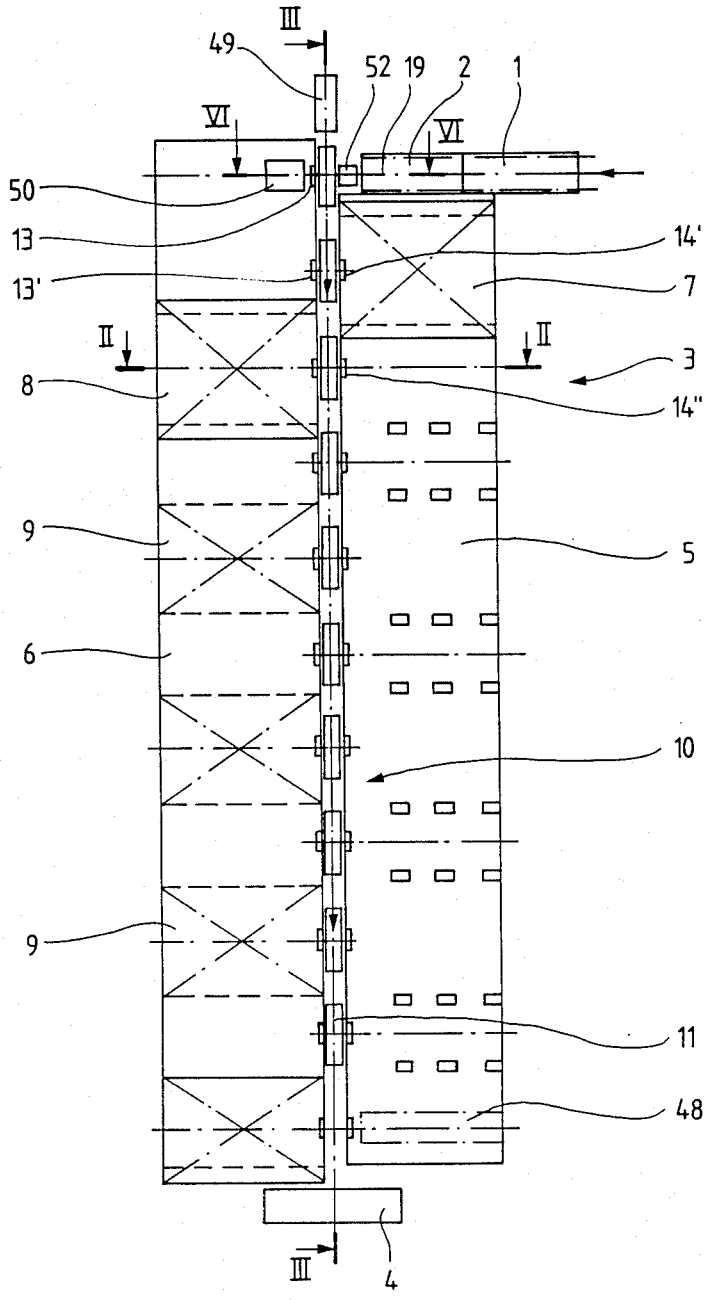
FIG. 1 is a schematically represented top view of the cable processing plant of the invention.

In accordance with the present invention, there is provided a transport device for electrical cables in a production station for processing of electrical cables 19 of a certain length, which includes at least one advance shifting device 25, stepwise movable in horizontal direction perpendicular to the axis of the cable ends 21, 22 and provided with grippers 18 which can be opened and closed and which support the cable ends 21, 22. The transport device includes a cable depository dump 4 at one end of the advance shifting device 25. The transport device comprises at least one receiver device 11 for receiving cables of different lengths. The receiver device 11 is step-wise movable in a circulation path 29, 40 by a drive device. An excessive length of the cable 19 can be inserted into a receiver device 11 and can, at least in the region of the cable dump 4, be again removed therefrom. The grippers 18 of the advance shifting device 25, gripping the two cable ends 21, 22, are disposed at a joint transfer module 17, 17', 17'' attached to a forward and backward movable transfer carrier 26. Said transfer module 17 is rotatable at least around an axis running perpendicular to the axis of the cable ends 21, 22 and perpendicular to the direction of motion of the advance shifting device 25. The cable ends 21, 22 are supported before and after the cycle stroke motion in a per se known manner by grippers 15, 16, 15', 16' of stationary gripper module 13, 14, 13', 14'.

The receiver device for the reception of cables 19 of different lengths is preferably a transport container 11.

The excess length of the cable 19, supported at one end, can be discharged by the cable feed 2 into the transport container 11 with the aid of a slidably disposed deflector 49. This deflector can be positioned in the circulation path 29, 40 and form a cable bundle 20. The deflector 49 can be a guide sheetmetal piece covering the full charge opening 11.1 of the transport container 11.

Preferably, the transport container 11 is provided with a rectangular base face with four side faces and an upwardly open charge opening 11.1. A double floor 12 can be disposed in the inside of the transport container 11. This double floor can be moved perpendicularly to the base face of the transport container 11 and serve as a discharge device. The transport containers 11 can be guided slidingly by rails 34, 35, 36, 37 on the circulation path 29. The drive unit, step-wise moving the transport containers 11, can be provided by pneumatic positioning members.

Preferably, a pull-out device 48, disposed at the end of the advance shifting device 25, can pull the cable 19 out of the transport container 11. The transport container 11 can be disposed on the circulation path 40 on a transport member 41 circulating continuously and endless. Preferably, at least the length of the charge opening 11.1 of the transport container 11 is greater than the length of the base face. At least one gripper module 13, 14, 13', 14' can be tiltably disposed around an axis running parallel to the direction of motion of the advance shifting device 25.

The receiver provision for different-length cables 19 can be provided with a transport compartment 62. This transport compartment can be formed by an endless circulating transport member 41. This transport member can at least be passed in advance direction 44 between two fixedly disposed side walls 55, 56 running parallel to the direction of motion and perpendicular to the running course of the transport member 41 and which is limited by webs 57, 58, 59 forming a perpendicularly protruding front and a rear wall.

The transport member can be a toothed belt 41 (FIGS. 8–10) and the protruding webs 57, 58, 59 can be an integrated component of the toothed belt 41 and be fixedly disposed on the toothed belt 41.

Two protruding webs 58, 59 can be parts of a U-shaped projection fixture 61. This projection fixture can be tiltably hinged in the center of the base 60 at the transport member 41, perpendicular to the direction of motion of the transport member 41. The subdivision of the projection FIG. 61 can be double the size at the transport member 41 as compared with the center distance between two webs 58, 59.

Figure 2:
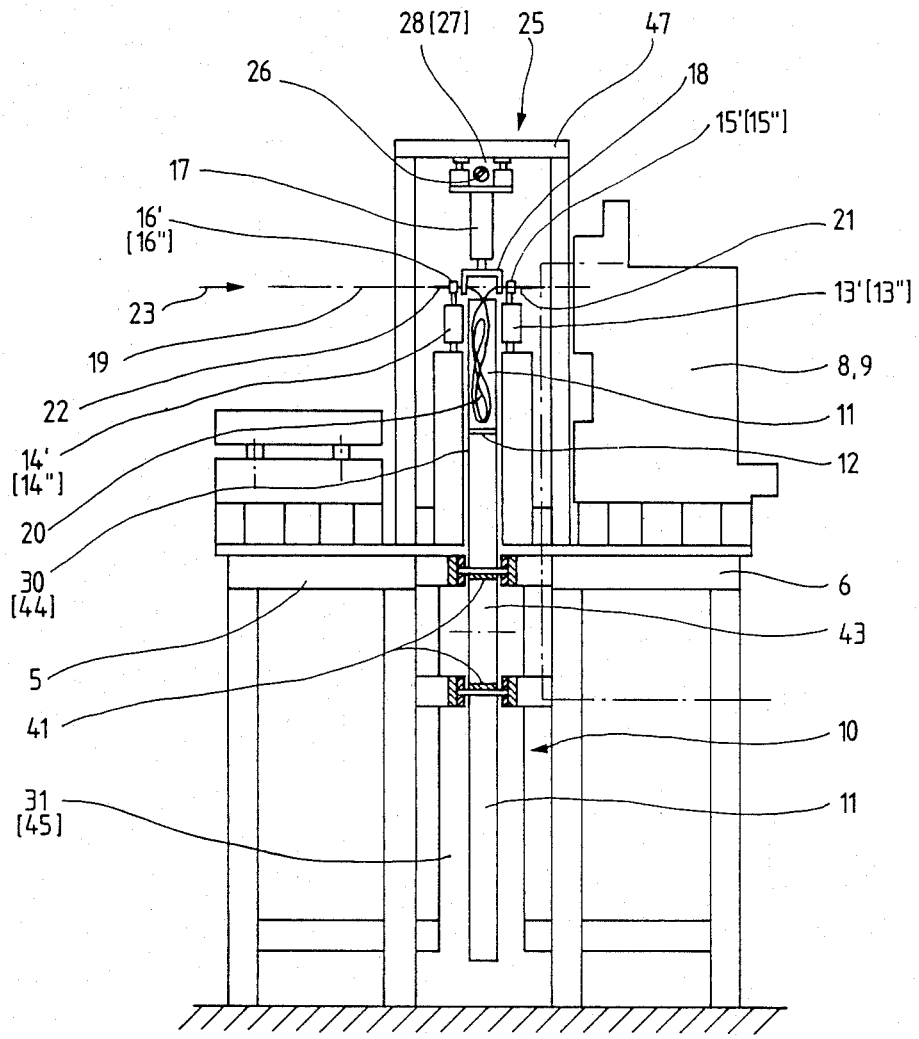
FIG. 2 is a cross-sectional view of the cable processing plant along section line II—II of FIG. 1.

The cable processing plant, which is preferably fully electronically controlled, illustrated in FIGS. 1 and 2, serves for the processing of insulated electrical cables 19. It comprises mainly a cable preselector 1, a cable-feed device 2 with a length-measuring device, and a cutting arrangement device, a cable-pulling module 50, a shiftably disposed deflector 49, a cable-processing line 3, a cable-depository dump 4, a possible cable pull-out device 48, and a preferably fully electronic microprocessor control. The microprocessor control can be provided with microprocessors commercially available such as, for example, the microprocessor 8086 by Intel Corporation, the microprocessor Z-80 by Zyloc Corporation, and the microprocessor 68000 by Motorola Corporation, as well as their predecessor and successor models. These microprocessors can be programmed with the respective assembly languages or by higher languages, which are compiled to the native code of the microprocessor. These microprocessors can be connected to final control elements which actuate various stations and members for transporting the cables.

The cable processing line 3 comprises two tables 5, 6 provided with quick-change plates, a plurality of processing stations, such as stripping stations 7, 8, various differently constructed presses 9, as well as a transporting device 10. The transporting device 10 comprises a number of different receiver devices, designated as transport containers 11 having a charge opening 11.1, a number of pairwise disposed stationary gripper modules 13, 14, and a shifting arrangement 25, comprising a plurality of cyclically forward and backward slidable transfer modules 17.

The transport containers 11 run along a closed circulation paths 29, 40 with an advance motion 30, 44, and a backward motion 31, 45, and with two reversal stations 32, 33.

Figure 3:
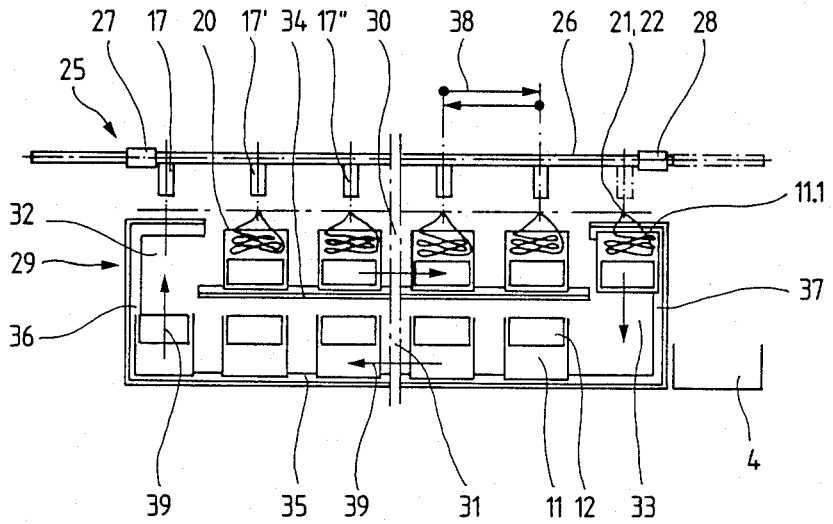
FIG. 3 is a sectional view of the cable processing plant along section line III—III of FIG. 1 with an embodiment for a cable transport device.
Figure 4:
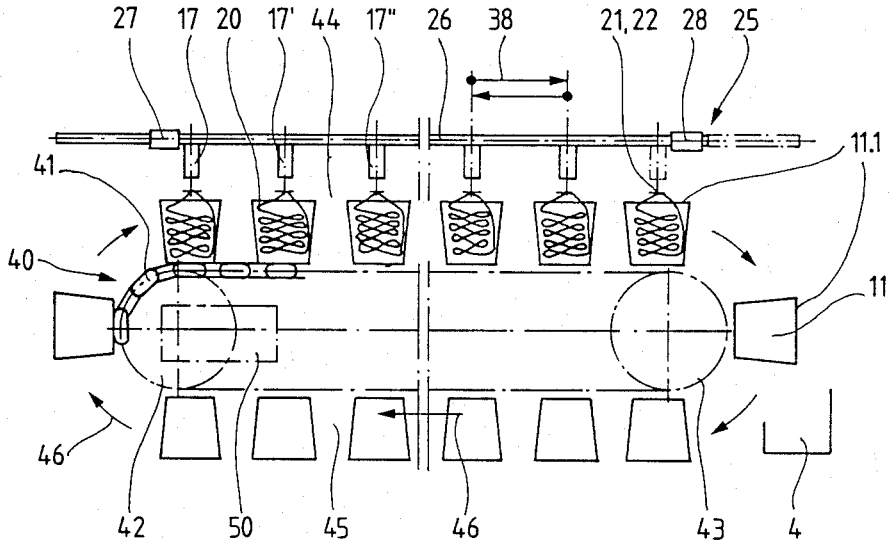
FIG. 4 is a sectional view of a cable processing plant along section line III—III of FIG. 1, with another embodiment for the cable transport device.

FIGS. 3 and 4 illustrate two variant embodiments of such a circulation path 29, 40. FIG. 3 illustrates a circulation path 29 with an advance rail 34, with a return rail 35, and with two deflection rails 36, 37. The transport containers 11 can be furnished with a discharge device formed as a slidable double-floor 12. Each transport container 11 is coordinated to a cable bundle 20 in the region of the advance rail 34, where the two cable ends 21, 22 of each individual cable bundle 20 are gripped alternatingly by grippers 15, 16 of the stationary gripper modules 13, 14, or by a gripper 18 of the slidable transfer module 17. The various transfer modules 17, 17', 17'' are attached at equal distances corresponding to a cycle stroke 38 at a transfer carrier 26 disposed parallel to the advance course 30. The transfer carrier 26 is shiftably guided at support bearings 27, 28 and is cyclically moved forward and backward, for example, by a pneumatic positioning element, not illustrated in detail.

The arrows 39 in FIG. 3 indicate the circulation direction for the transport containers 11. The cyclical shifting of the transport containers 11 can, for example, also be provided by pneumatic positioning elements, not illustrated. The cable depository dump 4 is furnished at the end of the cable processing line 3.

A circulation path 40 for the transport containers 11 with a transport member 41, for example a toothed belt or a chain, and two deflection wheels 42, 43, placed at a distance from each other and providing for an advance course 44 and a return course 45, are illustrated in FIG. 4. The arrows 46 indicate the course motion direction of the transport containers 11. Furthermore, a cable bundle 20 is coordinated in the area of the advance course 44 to each transport container 11 and the two cable ends 21, 22 of each individual cable bundle 20 are also gripped alternatingly by grippers 15, 16 of the stationary gripper modules 13, 14 or by grippers 18, 18' of the shiftable transfer module 17, 17', 17''. The shiftable transfer modules 17, 17', 17'' are also carried in this case by a transfer carrier 26 disposed parallel to the advance course 44 of the transport containers 11. The transfer carrier 26 is shiftably guided in support bearings 27, 28. The transfer carrier 26 can be moved forward and backward in cycles by a pneumatic positioning device, not illustrated, or by another drive unit. The transport containers 11 can furthermore be provided with shiftable or slidable double-floors 12, which discharge the cable bundle 20 at the end of the advance course 44 in a cable depository dump 4. The drive of the transport member 41 is performed step by step by a corresponding drive unit 50.

Figure 5:
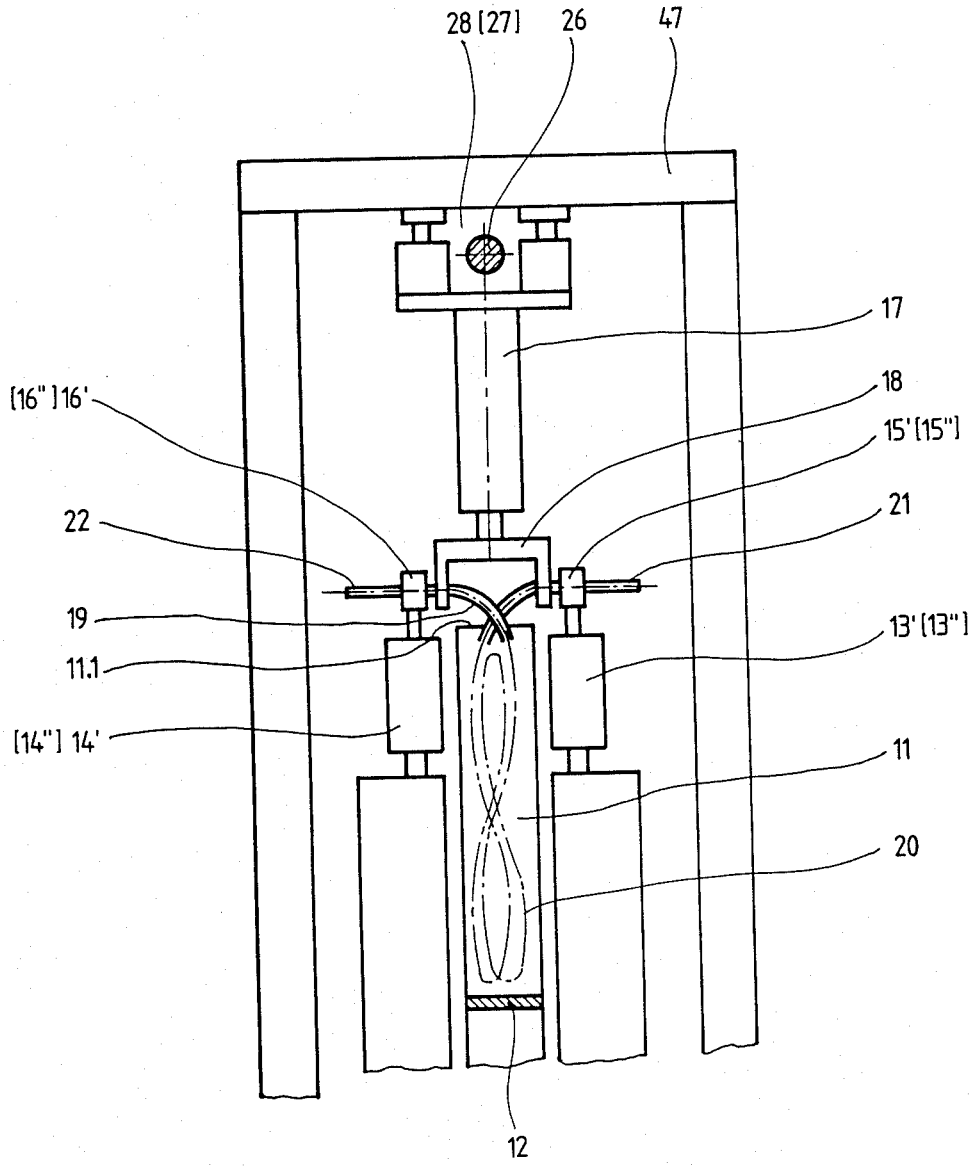
FIG. 5 is an enlarged detail view of the cable transfer station of FIG. 2.

The detail view of FIG. 5 illustrates the cable transfer station on a larger scale. The transport container is designated with the reference numeral 11. The slidable double-floor 12, which can be employed if desired, and the cable bundle 20 are disposed in the interior of the transport container 11. The two cable ends 21, 22 of the cable bundle 20 are gripped by grippers 15', 16' of the stationary gripper module 13', 14' and by the gripper 18 of the transfer module 17. The transfer modules 17 are attached at the transfer carrier 26 disposed above the transport containers 11 which, in turn, is slidably guided at the support bearings 27, 28 attached to the support frame 47. The transfer module 17 contains a rotating device which allows to rotate the grippers 18 and which provides in particular for rotations of the grippers 18 by 180 degrees around an axis perpendicular to the advance direction of the processing line. The rotation can be effected by a motor which is controlled by the microprocessor.

The distance of the grippers 18 from each other is preferably from about 20 to 100 times the diameter of the cable to be processed. The distance between the grippers 15, 16 from the grippers 18 is preferably from about 0.3 to 2.0 times the width of the grippers 15, 16, or of the grippers 18. The width of the transport container 11 is preferably from about 0.7 to 1.0 times the inner distance of the grippers 18 from each other. The slidable double-floor is preferably connected to an actuating member which can move said floor. Such actuating member is controlled by a microprocessor and can operate electrically or pneumatically.

Figure 6:
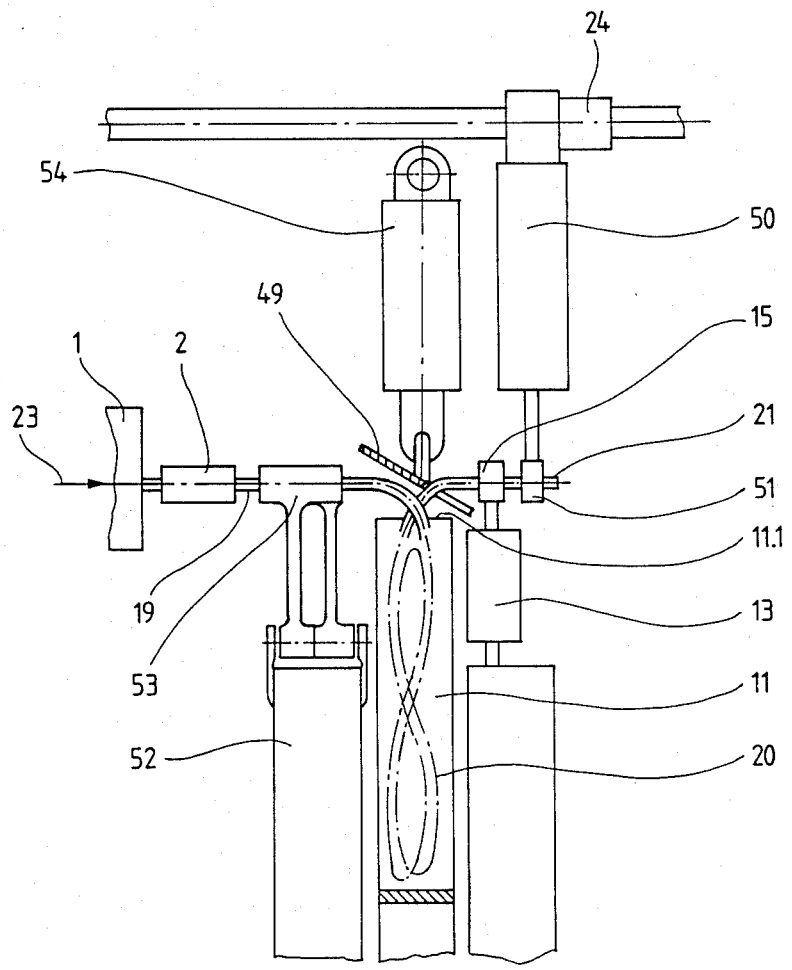
FIG. 6 is a sectional view of the cable feed station of FIG. 1 along section lines VI—VI of FIG. 1.

The detailed view of FIG. 6 illustrates schematically the region of the cable-feed station with the cable preselector 1, the cable feed 2, and a cable-pulling module 50 (FIG. 1) provided with a gripper 51. The cable-pulling module 50 is slidably disposed between the cable preselector 1 and a stop 24. A guide tube 53 of a guide module 52, comprising two halves tiltable around a horizontal axis, serves together with a deflector 49 of a shifting module 54, which deflector module can be shifted in the horizontal motion direction of the transport containers 11 above the charge opening 11.1 of the respective transport container 11, for guiding the cables 19 into the transport container 11. A cable bundle 20 inserted into the interior of the transport container 11 is indicated in FIG. 6. One end 21 of the cable 19 is gripped by a gripper 15 of a stationary gripper module 13.

Figure 7:
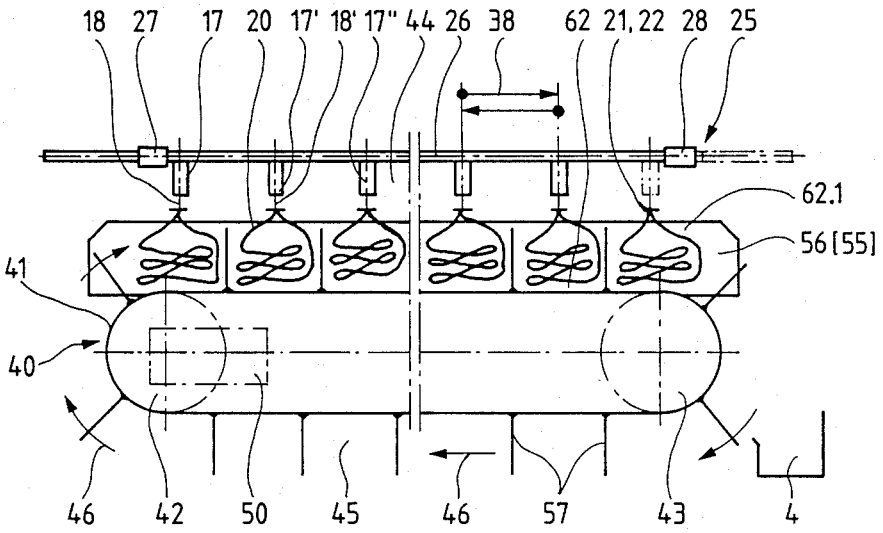
FIG. 7 is a sectional view of the cable processing plant, along section line III—III of FIG. 1, with another embodiment of the cable transport device.

A further embodiment of the invention of the circulation path 40 for the receiver devices is illustrated in FIG. 7, where the receiver devices are formed as transport compartments 62, which are formed by the transport member 41, for example a toothed belt or a chain with projecting webs 57, and two side walls 55, 56 fixedly disposed on the side next to the transport member 41, and which comprise a charge opening 62.1. The two deflection wheels 42, 43 of the transport member 41, disposed at a distance from each other, provide the advance course 44 and the return course 45. The arrows 46 indicate the course direction of the transport member 41. A cable bundle 20 is coordinated to each transport compartment 62 in the region of the advance course 44 and the two cable ends 21, 22 of each cable bundle 20 are alternatingly gripped by grippers 15, 16 of the stationary gripper module 13, 14 or by a gripper 18, 18' of a slidable transfer module 17, 17', 17'' of a shifting device 25. The slidable transfer modules 17, 17', 17'' are carried by a transfer carrier 26 disposed parallel to the advance course 44 of the transport member 41. The transfer carrier 26 is shiftably guided in the support bearings 27, 28 and can be moved cyclically forward and backward by a pneumatic positioning member, not illustrated, or by a different drive unit. The cycle stroke performed in each case is designated and represented by the reference numeral 38. The cable bundle 20 is discharged at the end of the advance course 44 in a cable depository dump 4 and, in its full length, is pulled out of the transport space and transferred in a stretched shape to the cable depository dump 4. The drive of the transport member 41 is also performed step by step by a corresponding drive unit 50.

Figure 8:
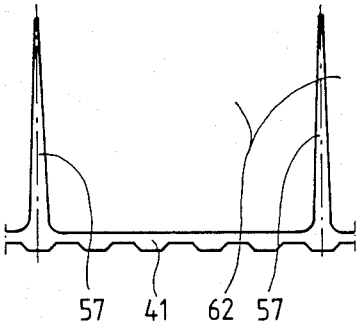
FIG. 8 is a detail view of a transport member with projecting webs.
Figure 9:
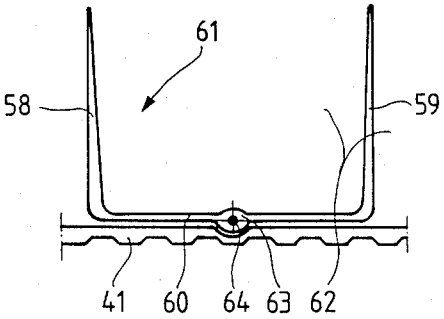
FIG. 9 is a detail view of a transport member with U-shaped projection fixtures.
Figure 10:
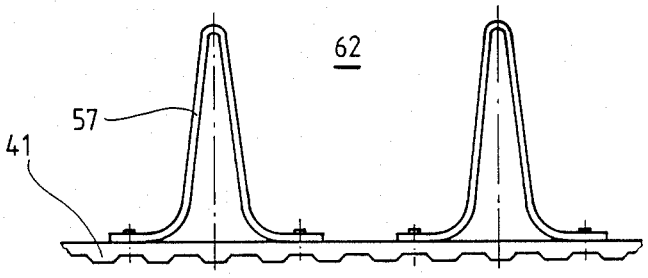
FIG. 10 is a detail view of a transport member with, for example, rivetted webs.

Three different embodiments for the transport member 41 of FIG. 7 are illustrated in FIGS. 8, 9, and 10. In each case, an endless circulating toothed belt is provided as an integrating component. Webs 57 are perpendicularly protruding from the course surface and are formed directly at the toothed belt. The webs 57 form, in each case, the transport compartment 62 between two webs 57, as illustrated in FIG. 8. Hinge elements 64 are disposed crosswise to the direction of motion and at uniform distances at the toothed belt, according to FIG. 9, and a U-shaped projection fixture 61 is hinged, in each case, to the hinge elements 64. The projection fixture 61 comprises a base 60 and two perpendicularly protruding webs 58, 59 and a support element 63, disposed in the center of the base 60, connectable to the hinge element 64 of the toothed belt. The transport compartments 62 are formed either between two webs 58, 59 belonging to and corresponding to a projection fixture 61 or between two webs 58, 59 belonging in each case to a neighboring projection fixture 61. Webs 57, rivetted for example to the toothed belt 41 (FIGS. 8–10), form the transport compartment 62, as illustrated in FIG. 10.

The above-described apparatus operates as follows:

The cable preselector 1 provides a connection member between the processing unit and a certain supply stock of cable. The cable preselector 1 brings a selected cable 19 into a receiver position where the protruding cable end 21 is gripped by the gripper 51 of the cable pulling module 50 and is pulled so far foward until the cable pulling module 50 contacts the stop 24. During this pulling motion, the cable feed 2 is inserted successively, which cable feed 2 comprises two advance bands pressing against the cable, the two-part guide tube 53 of the guide module 52, which grips around the cable 19, which tilts up, the deflector 49 formed as a guide sheet-metal piece is slid above the opening of the transport container 11 and the cable end 21 is gripped by the gripper 15 of the first stationary gripper module 13 (compare FIG. 6). The cable 19, gripped at one end, is pushed forward by the cable feed 2 and is guided with the aid of the deflector 49 through the charge opening 11.1 into the transport container 11 (compare FIG. 6). In this way, a cable bundle 20 is formed inside of the transport container 11 (FIGS. 5, 6). As soon as the predetermined length of the cable 19 has been determined by a measurement and cutting device, coordinated to the cable feed 2 and not illustrated in detail, then the two grippers 18 of the transfer module 17 grip the cable 19, and the cutting device separates the formed cable bundle 20 from the cable supply stock, while the guide tube 53 opens (FIG. 6) and the gripper 15 of the first stationary gripper module 13 releases the cable end 21. Thereby, the second gripped cable end 22 is generated. The transfer carrier 26, provided with additional transfer modules 17, now performs an advance stroke running perpendicular to the up-to-now performed cable motion actuated by a pneumatic positioning member, not illustrated in detail. Independent of this, the transport container 11 is moved in addition in forward direction at exactly the same cycle and in the same direction such that the cable bundle, together with the gripped cable ends 21, 22, moves forward simultaneously and perpendicular to the direction of the cable ends by a cycle stroke, where the two cable ends 21, 22 are again picked up by the grippers 15', 16' of a pair of stationary gripper modules 13', 14'. At the position is the first stripping station 7, which now strips the one cable end 22, while the transfer carrier 26, together with the coordinated transfer modules 17 with open grippers 18, performs a backward stroke. At the end of the cycle stroke, the gripper 18 of the first transfer module 17 grips the two cable ends 21, 22 of a new, in the meantime formed, cable bundle 20, while the gripper 18' of a second transfer module 17' grips the cable ends 21, 22 of the cable bundle, considered so far, and moves forward simultaneously with the corresponding transport container by a further cycle stroke to the position where the second stripping station 8 is disposed. The cyclical strokewise shifting of the cable 19 now continues until all desired and provided operations are performed at each cable end 21, 22 of a predetermined number of cables 19. Each completely processed cable 19 can, at the end of the processing line, either be dumped as a cable bundle 20 from the transport container 11 or can be discharged by a shifting of the insertable double-floor 12, or alternatively, the cable 19 can be pulled out of the transport container 11 with the aid of a pull-out device 48 in order to be available as a tensioned and stretched unit for further processing.

It can be recognized from FIGS. 3 and 4 in which way the transport containers 11 perform their continuous orbit 29, 40. For example, according to the embodiment of FIG. 3, in each case, an intermediate cycle stroke is required where the first transport container 11 is shifted upwardly and the last transport container is shifted downwardly before a work cycle stroke moves the upper row of the transport containers 11 in advance direction (forward course 30) and simultaneously the lower row in a return direction (reverse course 31). In this embodiment, each transport container 11 always assumes the same horizontal position. In this context, it would be possible to actuate the cable discharge device by a relative shifting of the double-floor 12 in vertical direction instead of at the end of the processing line, possibly also at any desired location in the course of the return course 31. The cyclical strokewise motion of the transport containers 11 is performed, for example, by pneumatic positioning members, not illustrated in detail, or by an electromechanical drive unit.

The transport containers 11 run along an endless circulation path 40 of the transport member 41, at an upper level in the region of the cable processing line 3 in advance path 44, and at a bottom level in return path 45, and at the two ends around the deflection wheels 42, 43, according to the embodiment of FIG. 4. The transport containers 11 assume, in this case, in advance motion 44 again a position with the charge opening disposed on top while, during the return course 45, this charge opening is disposed at the bottom. In this case, a shiftable double-floor 12 of the transport containers 11 can discharge the cable bundle 20 from the transport container 11 at the end of the processing line. It is also possible and conceivable that the cable bundle 20 is simply dumped out of the transport container during the circulation course of the transport container 11 around the deflection wheel 43 where, in addition, different types of the transport containers are possible as compared to those illustrated in FIGS. 3 and 4. The motion of the individual transport containers 11 is performed by the drive unit 50 (FIG. 4) driving the transport member 41 which, in fact, is also performed with cyclical strokes similar to those mentioned above.

The transfer carrier 26 with the transfer modules 17, 17', 17'' can be recognized in the two FIGS. 3 and 4. The transfer carrier 26 is shifted in the support bearings 27, 28 during a work cycle stroke in parallel to the path of motion of the transport containers 11 by a cycle stroke 38 in forward direction in order to be moved again successively by a cycle stroke 38 in backward direction into the starting position. During the forward stroke, the grippers 18 of the transfer modules 17 remain closed, and they are open during the backward stroke. In each cycle stroke or at each processing element, it is in addition possible that each individual transfer module 17 is rotated by 180 degrees around its vertical axis such that the two cable ends 21, 22 can be directed as desired to one or the other side of the cable processing line. It is thereby possible to provide on the two sides of the cable processing line 3 alternatingly different stripping stations 7, 8 and different presses 9 for the processing of each of the two cable ends 21, 22 or, alternatively, it is also possible to dispose only on one side of the processing line 3 different stripping stations 7, 8 and presses 9 successively, which also can be employed for the two ends of each cable 19.

It is furthermore conceivable to provide at least individual stationary gripper modules 13, 14, 13', 14' in addition for tilting, pivoting, sliding or shifting motions, if such motions become required for special processing or treatments of the cable ends such as, for example, the dipping of blank cable ends into a flux means or into a tinning bath, or for the avoiding of a gripper module ahead of a processing station in order to create a larger free space for the processing or the like.

It is further possible to provide, instead of a transport device with receiver provisions for cable bundles in the form of the transport containers 11, also such receiver provisions as the transport compartments 62 as they are described and illustrated in context of FIGS. 7, 8, 9, and 10.

It will be understood that each of the elements described above, or two or more together, may also find a useful application in other types of transport devices and cable processing procedures differing from the types described above.

While the invention has been illustrated and described as embodied in the context of a transport device for electrical cables in a production station for processing of electrical cables, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A transport device for electrical cables in a production station for processing of electrical cables of a certain length comprising a frame;

a cable supply station associated with the frame and furnishing a cable having an end to be picked up;

a forward shifting device movably supported by the frame which forward shifting device is stepwise movable in horizontal direction perpendicular to the direction of the cable ends;

a forward and backward movable transfer carrier movably supported on the frame;

a joint transfer module attached to the forward and backward movable transfer carrier, which transfer module is rotatable at least around an axis running perpendicular to the axis of the cable ends and perpendicular to the direction of motion of the forward shifting device;

movable grippers attached to the forward shifting device, which grippers can be opened and closed and which are provided to support the cable ends and for gripping the two cable ends;

a cable depository dump at one end of the forward shifting device;

a frame;

a drive device attached to the frame;

a stationary gripper module attached to the frame;

stationary grippers attached to the stationary gripper module;

a receiver device movably supported by the frame and adapted for receiving cables of different lengths and which receiver device is step-wise movable in a circulation path by the drive device, wherein a bulk length of the cable can be inserted into the receiver device and can, at least in the region of the cable dump, be removed again from the receiver device, where the cable ends are supported before and after a cycle stroke motion by the stationary grippers of the stationary gripper module.

2. The transport device according to claim 1, wherein the receiver device for the reception of cables of different lengths is a transport container.

3. The transport device according to claim 2 further comprising a shiftable deflector which can be moved and positioned into the circulation path;

a cable feed for moving cable from the cable supply and for discharging the excess length of a cable, supported at one end, into the transport container with the aid of the shiftable deflector thereby forming a cable bundle.

4. The transport device according to claim 3 wherein the deflector is a guide piece covering the full charge opening of the transport container.

5. The transport device according to claim 4 further comprising rails mounted to the frame such that the transport containers are guided slidingly by the rails on the circulation path; and where the drive unit, which is step-wise moving the transport containers, is provided by pneumatic positioning members.

6. The transport device according to claim 2 further comprising a base face disposed in the transport container with a surrounding side face wall of the transport container, which transport container includes an upwardly open charge opening;

a double floor disposed in the inside of the transport container; and means for moving the double floor in a direction perpendicular to the base face of the transport container such that the double floor serves as a discharge device.

7. The transport device according to claim 2 further comprising a pull-out device disposed at the end of the forward shifting device, which pull-out device can pull the cable out of the transport container.

8. The transport device according to claim 2 further comprising a transport member, wherein the transport container is disposed on the circulation path on the continuously and endlessly circulating transport member.

9. The transport device according to claim 2 wherein at least the length of the charge opening of the transport container is greater than the length of the base face.

10. The transport device according to claim 2, wherein at least one stationary gripper module is tiltably disposed around an axis running parallel to the direction of motion of the advance shifting device.

11. The transport device according to claim 1 further comprising an endless circulating transport member forming a transport compartment provided in the receiver provision for different-length cables;

two fixedly disposed side walls running parallel to the direction of motion and perpendicular to the running course of the transport member, where the transport compartment is provided in advance direction between the two fixedly disposed sidewalls;

webs delimiting the transport compartment, which webs form a front and a rear wall which is protruding perpendicularly.

12. The transport device according to claim 11, wherein the transport member is a toothed belt and wherein the protruding webs are an integrated component of the toothed belt and are fixedly disposed on the toothed belt.

13. The transport device according to claim 11 further comprising a U-shaped projection fixture, which is tiltably hinged in the center of the base at the transport member, perpendicular to the direction of motion of the transport member, wherein the two protruding webs are parts of the U-shaped projection fixture, where the subdivision of the projection figure is double the size at the transport member as compared with the center distance between two webs.

14. A method for the transporting of cable sections comprising transporting a cable to a transfer position;

gripping the cable with a gripper of a cable pulling module attached to a frame;

pulling the cable so far until the cable pulling module contacts a stop element;

inserting the cable into a cable feed;

opening a guide tube composed of two half-cylinders and surrounding the cable;

sliding a deflector above the opening of the transport container;

gripping the cable end by a gripper of a first stationary gripper module attached to the frame;

advancing the cable gripped on one side with the cable feed;

directing the cable with the deflector into the charge opening of the transport container;

forming a cable bundle in the transport container;

measuring the length of the advanced cable;

cutting the cable length to a desired size;

gripping the cable with the two grippers of the transfer module;

separating the formed cable bundle from the cable supply; opening the guide tube;

releasing the cable by the gripper of the first stationary gripper module;

advancing the transfer module by an advance stroke in forward direction simultaneously with the transport container at the same cycle for moving the cable bundle together with the gripped cable ends in a direction perpendicular to the cable ends;

gripping the cable ends with a pair of stationary gripper modules;

releasing the cable by the grippers of the transfer module; and performing a return stroke of the transfer module.

15. The method for the transporting of cable sections, according to claim 14 further comprising processing the cable gripped by the grippers of the stationary gripper module gripping the cable ends with grippers of a second transfer module;

releasing the cable gripped by the grippers of the stationary gripper module advancing the cable; and dumping the processed cable into a depository dump.

16. A transport device for electrical cables in a production station for processing of electrical cables (19) of a certain length which includes a frame, at least one advance shifting device (25) movable attached to the frame, stepwise movable in horizontal direction perpendicular to the axis of the cable ends (21, 22) and provided with grippers (18) which can be opened and closed and which support the cable ends (21, 22) and which transport device includes a cable depository dump (4) at one end of the advance shifting device (25), characterized in that the transport device comprises at least one receiver device (11) for receiving cables of different lengths and which said receiver device (11) is step-wise movable in a circulation path (29, 40) by a drive device, wherein an excessive length of the cable (19) can be inserted into said receiver device (11) and can, at least in the region of the cable dump (4), be removed again therefrom, and that the grippers (18) of the advance shifting device (25), gripping the two cable ends (21, 22), are disposed at a joint transfer module (17, 17′, 17″) attached to a forward and backward movable transfer carrier (26), which transfer module (17) is rotatable at least around an axis running perpendicular to the axis of the cable ends (21, 22) and perpendicular to the direction of motion of the advance shifting device (25), where the cable ends (21, 22) are supported before and after the cycle stroke motion in a per se known manner by grippers (15, 16, 15', 16') of stationary gripper module (13, 14, 13', 14').

17. The transport device according to claim 16, characterized in that the receiver device for the reception of cables (19) of different lengths is a transport container (11).

18. The transport device according to claim 17, characterized in that the excess length of the cable (19), supported at one end, is discharged by the cable feed (2) into the transport container (11) with the aid of a slidably disposed deflector (49) which can be positioned in the circulation path (29, 40) and which forms a cable bundle (20) and wherein the deflector (49) is a guide sheetmetal piece covering the full charge opening (11.1) of the transport container (11).

19. The transport device according to claim 17, wherein the transport container (11) is provided with a rectangular base face with four side faces and an upwardly open charge opening (11.1) and wherein a double floor (12) is disposed in the inside of the transport container (11), which double floor can be moved perpendicularly to the base face of the transport container (11) and which double floor can serve as a discharge device; and wherein the transport containers (11) are guided slidingly by rails (34, 35, 36, 37) on the circulation path (29), and the drive unit, which is step-wise moving the transport containers (11), is provided by pneumatic positioning members.

20. The transport device according to claim 17, wherein a pull-out device (48) is disposed at the end of the advance shifting device (25), which can pull the cable (19) out of the transport container (11);

wherein the transport container (11) is disposed on the circulation path (40) on a transport member (41) circulating continuously and endless;

wherein at least the length of the charge opening (11.1) of the transport container (11) is greater than the length of the base face;

wherein at least one gripper module (13, 14, 13', 14') is tiltably disposed around an axis running parallel to the direction of motion of the advance shifting device (25).

21. The transport device according to claim 16, characterized in that the receiver provision for different-length cables (19) is provided with a transport compartment (62), which is formed by an endless circulating transport member (41), which is at least passed in advance direction (44) between two fixedly disposed sidewalls (55, 56) running parallel to the direction of motion and perpendicular to the running course of the transport member (41) and which is limited by webs (57, 58, 59) which form a front and a rear wall which is protruding perpendicularly.

22. The transport device according to claim 21, characterized in that the transport member is a toothed belt (41) and that the protruding webs (57, 58, 59) are an integrated component of the toothed belt (41) and are fixedly disposed on the toothed belt (41).

23. The transport device according to claim 21, characterized in that two protruding webs (58, 59) are parts of a U-shaped projection fixture (61), which is tiltably hinged in the center of the base (60) at the transport member (41), perpendicular to the direction of motion of the transport member (41), where the subdivision of the projection figure (61) is double the size at the transport member (41) as compared with the center distance between two webs (58, 59).

* * * * *